US005183428A

United States Patent [19]

Lin

[11] Patent Number: 5,183,428

[45] Date of Patent: Feb. 2, 1993

[54] BUBBLE BLOWING TOY

[76] Inventor: Mon S. Lin, No. 195, Chieng-Kou Road, Hsintien City, Taipei Hsien, Taiwan

[21] Appl. No.: 804,750

[22] Filed: Dec. 11, 1991

[51] Int. Cl.[5] ..... A63H 33/28

[52] U.S. Cl. ..... 446/15; D21/61

[58] Field of Search ..... 446/15, 19; D21/61

[56] References Cited

U.S. PATENT DOCUMENTS

| | | | |
|---|---|---|---|
| D. 304,466 | 11/1989 | Brown | 446/15 X |
| 4,790,787 | 12/1988 | Rector | 446/15 |
| 4,923,426 | 5/1990 | Klundt | 446/15 X |
| 4,943,255 | 7/1990 | Klundt | 446/15 |

FOREIGN PATENT DOCUMENTS

| | | | |
|---|---|---|---|
| 85529 | 5/1955 | Norway | 446/15 |

*Primary Examiner*—Mickey Yu

*Attorney, Agent, or Firm*—Bacon & Thomas

[57] ABSTRACT

A bubble blowing toy includes a scabbard and a body composed of a grip and a blade having an oblong ring element of an adequate length at the blade, with a hollow space in the middle of the ring element and a plurality of recesses along the ring element so big bubbles can be formed by swinging of the body, and small bubbles can be formed by blowing through the hollow space with the mouth.

4 Claims, 5 Drawing Sheets

BUBBLE BLOWING TOY

BACKGROUND OF THE INVENTION

Conventional bubble blowing toys, can be categorized into two types. First, as shown in FIG. 1, there is a bubble ring 1 of a large diameter for absorbing soap solution from a dish 2 for forming bubbles by swinging the bubble ring 1. Second, as shown in FIG. 2, there is a bubble ring 3 of a considerably smaller diameter for absorbing soap solution from a bottle for forming bubbles by blowing through the bubble ring 3 with the mouth. The larger bubble ring is not convenient because it requires a large dish of soap solution during playing. The smaller bubble ring, though convenient because it only requires a relatively small bottle for the soap solution, can only form small bubbles.

The present invention provides a bubble blowing toy configured substantially in the form of a sword which can form big bubbles by swinging the toy and small bubbles by blowing through the toy with the mouth. The invention has the following characteristics:

1. It has a ring element of appropriate length forming its blade portion and which blade portion can be inserted into a scabbard so that it serves as a toy sword as well.

2. The ring element of the blade portion has a hollow space in the middle for adhesion of the soap solution to form big bubbles by swinging, and small bubbles by blowing through the hollow space with the mouth. This structure eliminates the disadvantages of the conventional bubble toys which can only form either big or small bubbles.

3. The flanks of the ring element may be expanded to increase the area for adhesion of the soap solution and consequently increase the size of the bubbles formed.

4. The design of the sword and the scabbard facilitates transporting the toy. The soap solution is tightly sealed within the scabbard so that the toy can be turned up-side-down to permit the ring element to be fully adhered with the soap solution. A spare soap solution container is provided in the grip of the sword for replenishing soap solution in the scabbard.

SUMMARY OF THE INVENTION

The main object of the present invention is to provide a bubble blowing toy, particularly a toy substantially in the form of a sword with a scabbard, comprising a body composed of a grip and a blade having an oblong ring element of an adequate length along the blade, with a hollow space in the middle of the ring element and a plurality of recesses along the ring element so that big bubbles can be formed by swinging the body, and small bubbles can be formed by blowing through the hollow space with the mouth, and a scabbard to hold the soap solution and within which the blade is inserted to absorb soap solution for forming bubbles.

DETAILED DESCRIPTION OF THE PREFERRED EMBODIMENT

Figure 1:
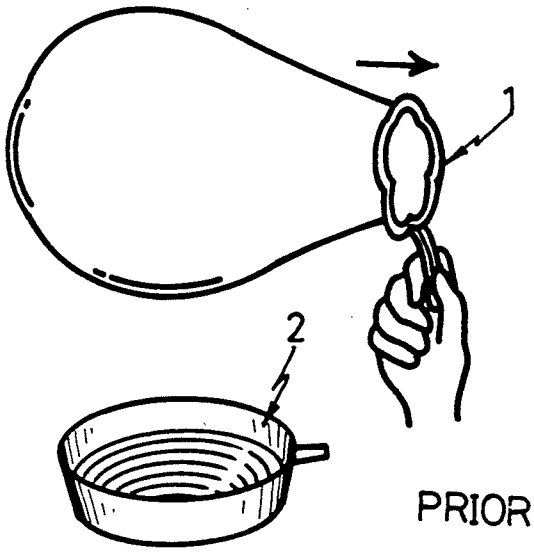
PRIOR ART FIG.1
FIG. 1 illustrates a conventional bubble ring of a first type.
Figure 2:
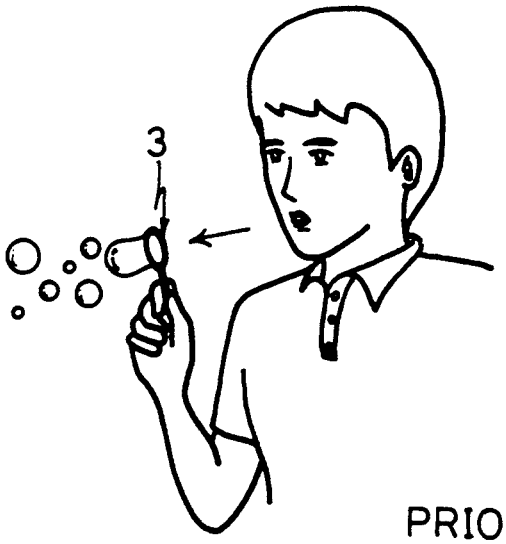
PRIOR ART FIG.2
FIG. 2 illustrates a conventional bubble ring of a second type.
Figure 3:
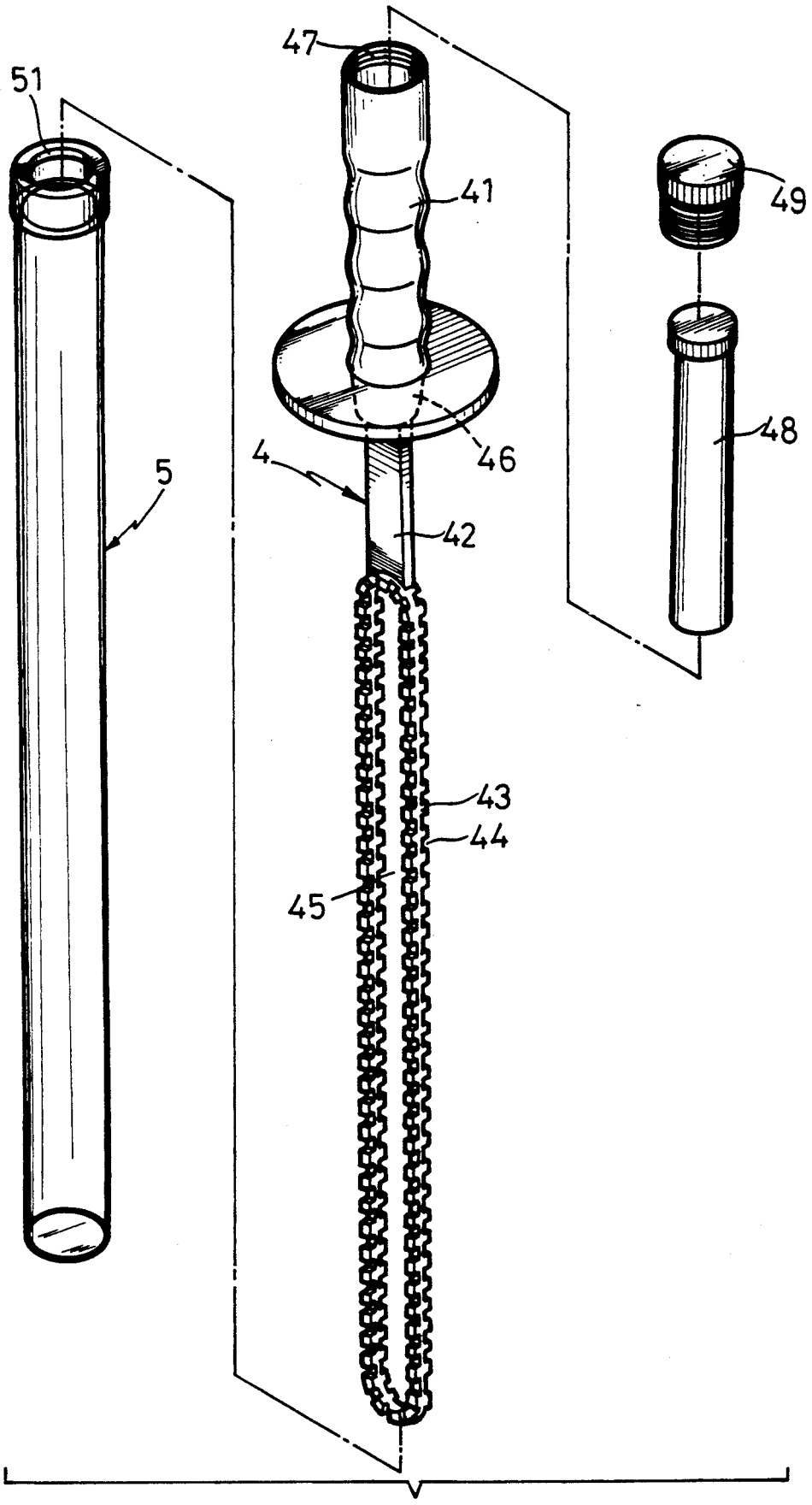
FIG. 3 is an exploded perspective view of a bubble blowing toy according to a first embodiment of the present invention.
Figure 4:
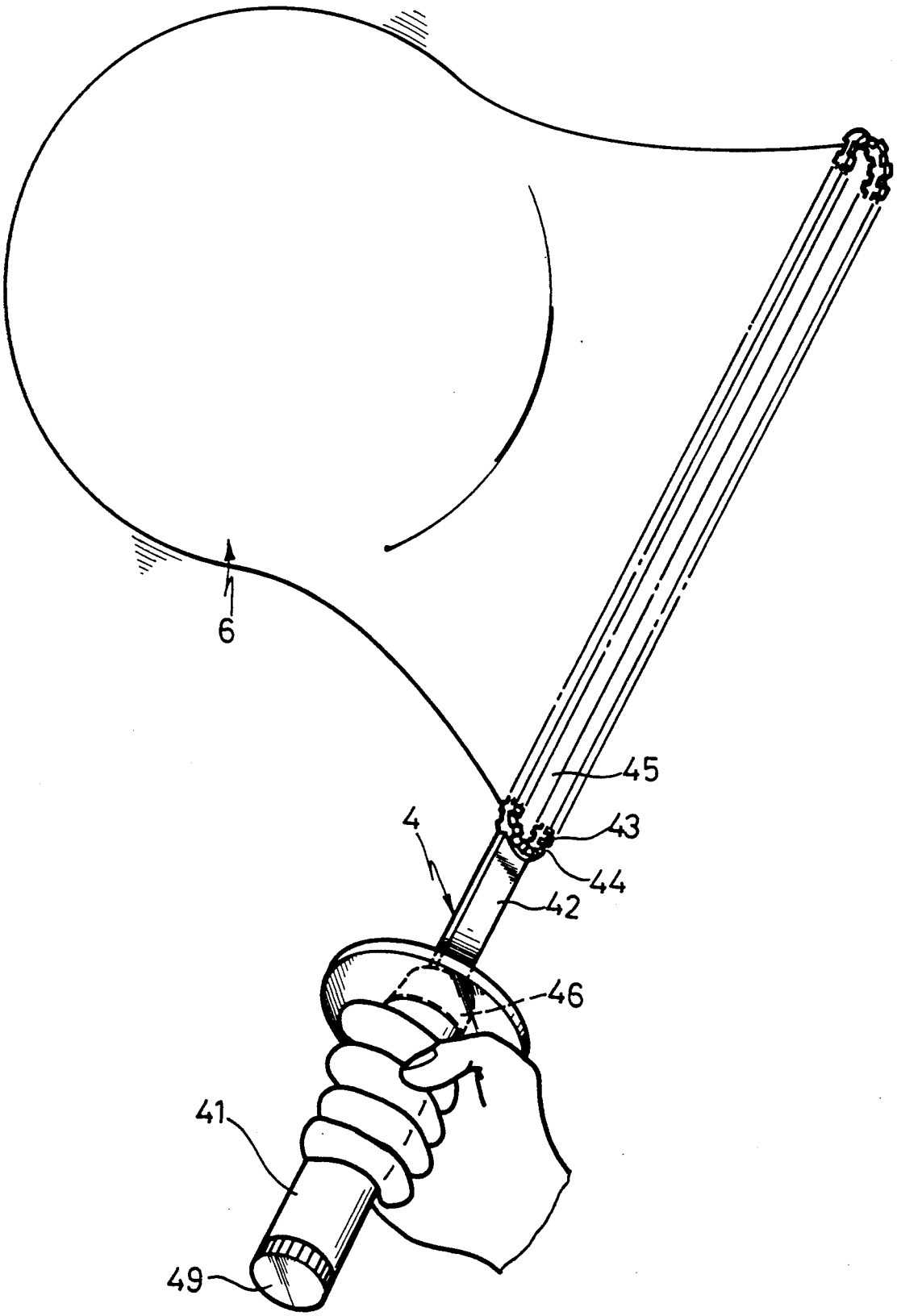
FIG. 4 illustrates a first way of using the bubble blowing toy according to the first embodiment.

As shown in FIG. 3, the present invention includes a body 4 on which a grip 41 and blade 42 are formed so that it is substantially in the form of a sword. An oblong ring element 43 of an adequate length extends along the blade 42 at an appropriate position. The ring element 43 is formed with a plurality of spaced recesses 44 therealong and a hollow space 45 in the middle, and the blade 42 is sized so that it can be inserted into a scabbard 5 within which soap solution is contained. By inserting the blade 42 into the scabbard 5 with the soap solution, the recesses 44 on ring element 43 of the blade 42 can absorb the soap solution. Then, as shown in FIG. 4, after withdrawing the body 4 from the scabbard 5 and swinging the body 4, large bubbles 6 are formed from the soap solution adhered within the recesses 44 by the air flow through the hollow space 45. By the design of the body 4 and the scabbard 5, the soap solution in the scabbard will not leak and it is very convenient to carry the bubble blowing toy according to the present invention.

Figure 5:
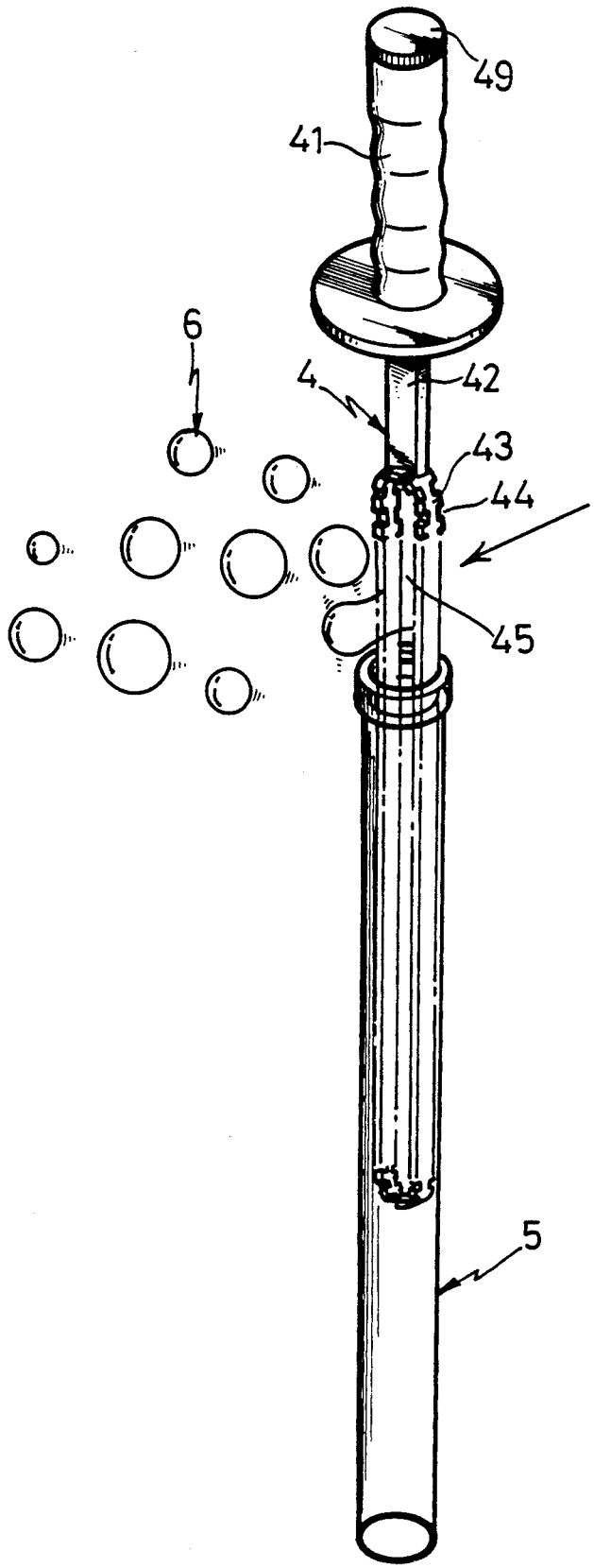
FIG. 5 illustrates a second way of using the bubble blowing toy according to the first embodiment.

As shown in FIG. 5, blowing by the mouth through the hollow space 45 will cause the formation of small bubbles 6 from the ring element 43. As also shown in FIG. 3, there is a tapered plug element 46 between the grip 41 and the blade 42 corresponding to the opening 51 of the scabbard 5 in order to seal the scabbard 5. In this way, the scabbard 5 can be reversed or turned up-side-down without leakage of any soap solution, thus permitting the ring element 43 to be fully adhered with soap solution.

As further shown in FIG. 3, a cavity 47 is formed in the grip 41 for holding a soap solution container 48 which is kept in the cavity 47 and closed by plug 49. The soap solution in the scabbard 5 can be replenished with soap solution from container 48.

Figure 6:
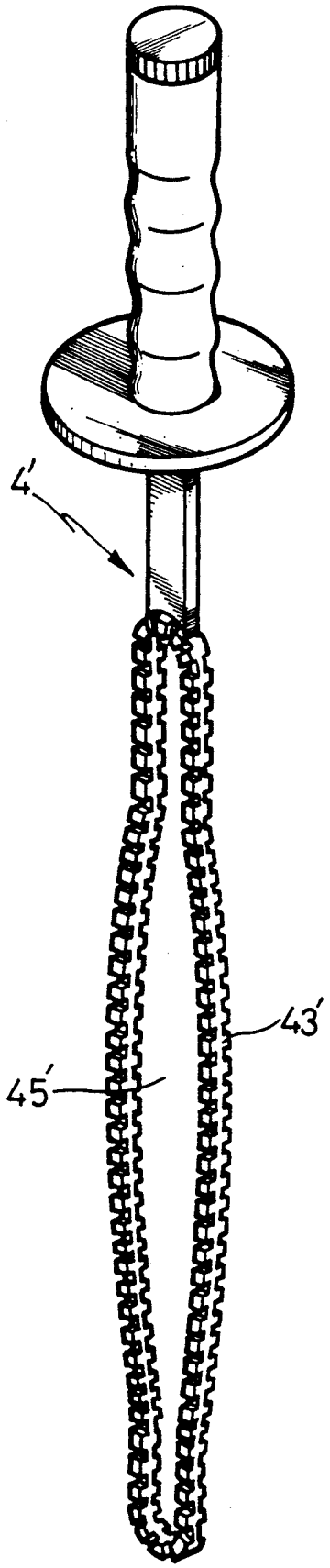
FIG. 6 illustrates another embodiment of the bubble blowing toy according to the present invention.

As indicated in FIG. 6, the middle section of the ring element 43' can be formed with expandable flanks so that there is an expanded hollow space 45' for adhesion of soap solution, thus permitting larger bubbles to be formed. The ring element 43' of such a shape is made of soft and flexible plastic material so that the flanks can be compressed for properly inserting the body 4' back into the scabbard 5.

I claim:

1. A bubble blowing toy comprising:

a) a body in substantially the configuration of a sword defined by a grip portion and a blade portion;

b) a first container in substantially the configuration of a scabbard for containing a soap solution and slideably receiving the blade portion therein;

c) the blade portion being partially define by an oblong shaped ring element provided with a plurality of recesses spaced therealong for absorbing the soap solution;

d) plug means carried by the body for insertion within the first container and sealing the soap solution therein when the blade portion is fully received within the first container; and e) wherein the body may be used for either blowing larger bubbles by swinging the body through the air or blowing smaller bubbles by blowing through the ring element with the mouth.

2. The bubble blowing toy of claim 1 wherein the grip portion is hollow and further including:

a) a second container for containing a soap solution, the second container being receivable within a hollow in said grip portion; and b) detachable means for securing the second container within the grip portion.

3. The bubble blowing toy of claim 1 wherein the plug means is of a tapered configuration.

4. The bubble blowing toy of claim 1 wherein the ring element of the blade portion is formed from flexible plastic material for permitting flank portions of the ring element to be expanded outwardly and compressed inwardly.

* * * * *